US010256591B2

(12) United States Patent
Misu

(10) Patent No.: US 10,256,591 B2
(45) Date of Patent: Apr. 9, 2019

(54) CONNECTOR

(71) Applicant: Sumitomo Wiring Systems, Ltd., Yokkaichi, Mie (JP)

(72) Inventor: Takeshi Misu, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 15/793,014

(22) Filed: Oct. 25, 2017

(65) Prior Publication Data

US 2018/0123305 A1 May 3, 2018

(30) Foreign Application Priority Data

Nov. 1, 2016 (JP) ..... 2016-214429

(51) Int. Cl.
*H01R 43/24* (2006.01)
*H01R 13/405* (2006.01)

(52) U.S. Cl.
CPC ..... *H01R 43/24* (2013.01); *H01R 13/405* (2013.01)

(58) Field of Classification Search
CPC ..... H01R 43/24; H01R 13/405
USPC ..... 439/606, 695, 686
See application file for complete search history.

(56) References Cited

U.S. PATENT DOCUMENTS 3,611,257 A * 10/1971 Carkhuff ..... H01R 43/24 439/587
4,398,785 A * 8/1983 Hedrick ..... H01R 43/24 264/255
4,718,865 A * 1/1988 Cordeiro ..... H01R 13/405 439/606
5,964,622 A * 10/1999 Ishikawa ..... B29C 45/1671 439/606
6,482,036 B1 * 11/2002 Broussard ..... H01R 13/523 439/606

FOREIGN PATENT DOCUMENTS

JP 2015-174697 10/2015

* cited by examiner

*Primary Examiner* — Gary F Paumen
(74) *Attorney, Agent, or Firm* — Gerald E. Hespos; Michael J. Porco; Matthew T. Hespos

(57) ABSTRACT

A housing (11) of a connector (10) includes a base (11*a*) composed of a core portion (14) and an upper end covering (17) of a resin molded portion (15) covering an upper end surface (14*a*) of the core (14). Metal terminals (12) are embedded in the housing (11) penetrate through the core (14) and the upper end covering (17) in the base portion (11*a*), and tips (12*a*) thereof project out of the base (11*a*) from a surface (17*a*) of the upper end covering portion (17). First recesses (14*b*) are formed between the metal terminals (12) on an upper end contact surface (14*a*) of the core (14) with the upper end covering (17).

7 Claims, 2 Drawing Sheets

CONNECTOR

BACKGROUND

Field of the Invention

The invention relates to a connector configured by embedding metal terminals in a housing made of resin.

Description of the Related Art

Japanese Unexamined Patent Publication No. 2005-174697 discloses a connector with a housing formed by insert molding with a core made of resin and holding metal terminals as an insert article. This housing includes a base composed of the core and a covering that covers at least a part of the core. Each metal terminal is embedded partially in the base of the housing. Specifically, each metal terminal penetrates through the core and the covering in the base and a tip part thereof projects out of the base from a surface of the covering. A proper creepage distance is required for electrical insulation between the metal terminals of the above-described connector and can be difficult to ensure.

The invention was developed to solve the above problem and aims to provide a connector capable of ensuring a creepage distance between a plurality of metal terminals.

SUMMARY

A connector to solve the above problem includes metal terminals, and a housing including a core made of resin and having each metal terminal partially embedded therein. The connector also has a resin molded portion formed by insert molding with the metal terminals and the core as insert articles. The housing includes a base portion composed of the core and a covering of the resin molded portion covering at least a part of the core. Each metal terminal penetrates through the core and the covering in the base and a tip part thereof projects out from the base from a surface of the covering. A projection or a recess is formed between the metal terminals on a contact surface of the core with the covering. The projection or recess between the metal terminals on the contact surface of the core with the covering ensures a creepage distance between the metal terminals on a boundary surface of the core and the covering portion inside the base.

The connector of one embodiment has a recess formed between the metal terminals on the contact surface of the core, and a part of the resin molded portion is fit into the recess. More particularly, a projection may be formed on a back surface (close-contact surface with the core) of the covering that is insert-molded with the core as an insert article, and the projection may be fit into the recess of the core. The recess of the core and the projection on the back surface of the covering ensures the creepage distance between the metal terminals while suppressing enlargement of the base by thinning the covering.

DETAILED DESCRIPTION

One embodiment of a connector is described with reference to FIGS. 1 to 4. Note that, in the following description, three directions orthogonal to each other (X, Y and Z in figures) are respectively referred to as a width direction X, a depth direction Y, and a height direction Z of the connector.

Figure 1:
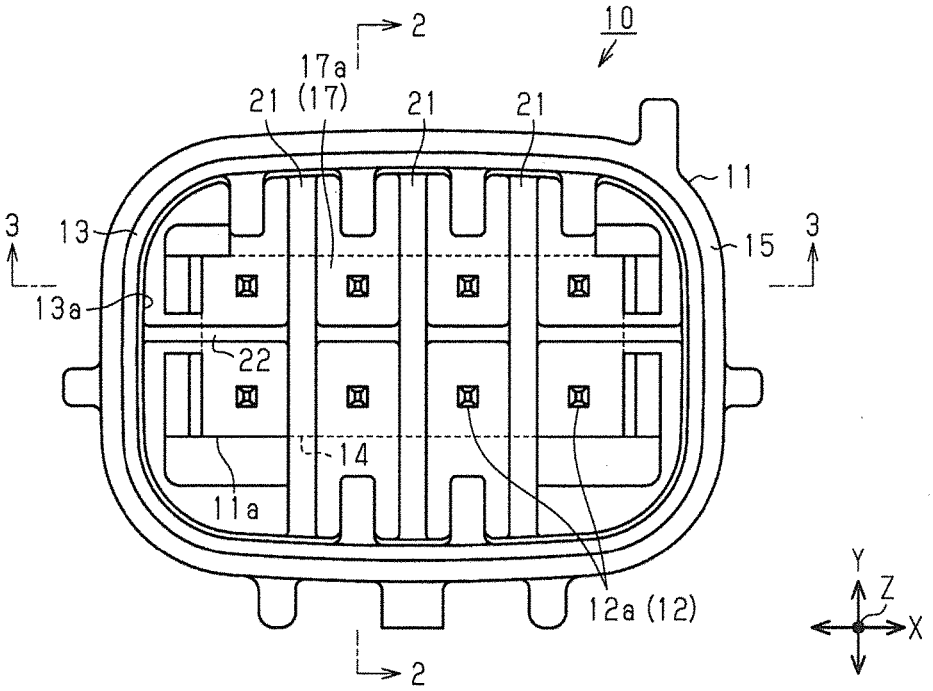
FIG. 1 is a front view of a connector of an embodiment.
Figure 2:
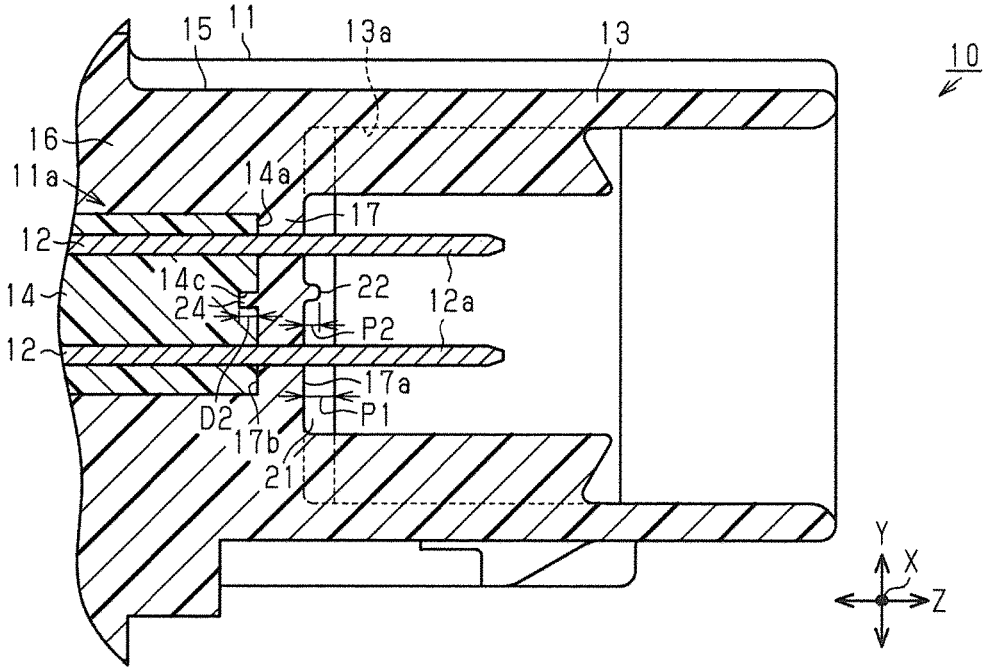
FIG. 2 is a section along 2-2 in FIG. 1.

As shown in FIGS. 1 and 2, a connector 10 of this embodiment includes a housing 11 formed by injection molding of a synthetic resin, and metal terminals 12 (eight in this embodiment) partially embedded in the housing 11. Each metal terminal 12 is formed of a metal wire material, and has a tip 12*a* that is fit into a tubular fitting 13 in the housing 11. The tip 12*a* is to be connected to a terminal (not shown) of a mating connector. Each metal terminal 12 further a base end opposite to the tip 12*a*. The base end of each metal terminal 12 is connected, for example, to a printed board (not shown).

The housing 11 is formed by insert molding with the respective metal terminals 12 and a core 14 made of resin and holding the respective metal terminals 12 as insert articles. Specifically, the housing 11 includes a resin molded portion 15 including the core 14 inside. Note that, in this embodiment, a primarily molded body M (see FIG. 4) composed of the metal terminals 12 and the core 14 is fabricated by primary insert molding with the respective metal terminals 12 as insert articles and, subsequently, the resin molded portion 15 is formed by secondary insert molding with that primarily molded body as an insert article.

Figure 4:
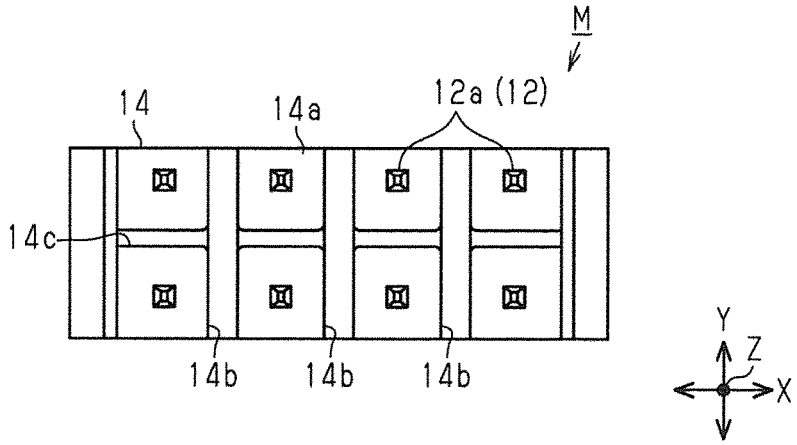
FIG. 4 is a front view of a core portion.

As shown in FIGS. 1, 2 and 4, the core 14 has a substantially rectangular parallelepiped shape with an upper end surface 14*a* perpendicular to the height direction Z. A part of each metal terminal 12 extending in the height direction Z is embedded in the core 14.

As shown in FIGS. 1 and 2, the resin molded portion 15 is formed with a side covering 16 for covering sides of the core 14 in the width direction X and the depth direction Y and the tubular fitting 13 extending in the height direction Z from the side covering 16. Further, the resin molded portion 15 is formed with an upper end covering 17 extending from an inner side surface 13*a* of the fitting 13 covering the upper end surface 14*a* of the core 14. The core 14 and the upper end covering 17 constitute a base 11*a* of the housing 11 holding the respective metal terminals 12. Note that the upper end surface 14*a* of the core 14 is smaller than the inner side surface 13*a* of the tubular fitting 13 in the width direction X and the depth direction Y.

The metal terminals 12 penetrate through the base 11*a* (core 14 and upper end covering 17) of the housing 11 in the height direction Z. The tips 12*a* of the respective metal terminals 12 projecting along the height direction Z from a surface 17*a* of the upper end covering 17 are located inside the fitting 13. Further, the respective metal terminals 12 (tip parts 12*a*) are arranged in a matrix manner in the width direction X and the depth direction Y and, in this embodiment, are arranged in four rows in the width direction X and in two rows in the depth direction Y. Further, the metal terminals 12 are arranged at equal intervals in the width direction X.

The surface 17*a* of the upper end covering 17 constitutes a bottom surface (fitting bottom surface) of the fitting 13. Further, a surface of the upper end covering 17 opposite to the surface 17*a* defines a close-contact surface 17*b* held in close contact with the upper end surface 14*a* of the core 14 by the secondary insert molding. The surface 17*a* of the upper end covering 17 is formed with first projections 21 and a second projection 22 in the form of ribs projecting in the height direction Z.

Figure 3:
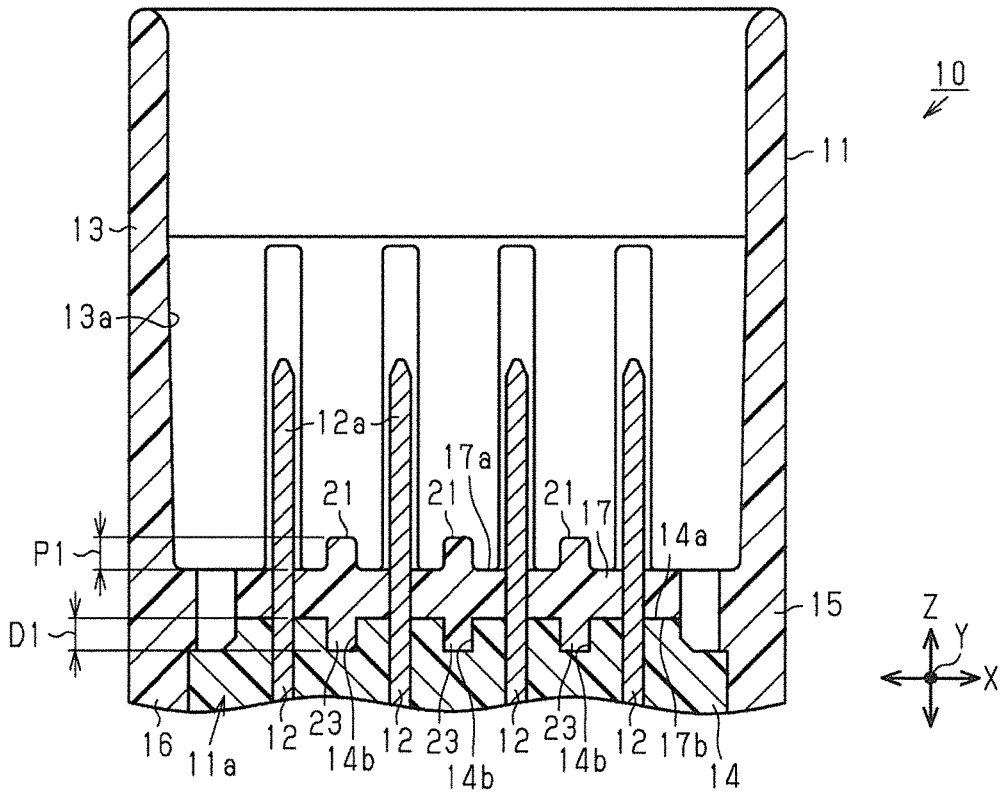
FIG. 3 is a section along 3-3 in FIG. 1.

As shown in FIGS. 1 and 3, three first projections 21 extend straight along the depth direction Y between adjacent ones of the four metal terminals 12 arranged in the width direction X. Further, both ends of each first projection 21 in the depth direction Y are connected to the inner side surface 13*a* of the fitting 13.

As shown in FIGS. 1 and 2, the second projection 22 is formed straight along the width direction X between the metal terminals 12 arranged in the depth direction Y. The second projection 22 is perpendicular to the first projections 21 and both ends thereof are connected to the inner side surface of the fitting portion 13. Note that a projecting amount P2 of the second projection 22 in the height direction Z is smaller than a projecting amount P1 of the first projections 21 in the height direction Z.

As shown in FIGS. 2, 3 and 4, the upper end surface 14*a* of the core 14 held in close contact with the close-contact surface 17*b* of the upper end covering 17 is formed with first recesses 14*b* and a second recess 14*c* perpendicular to each other.

As shown in FIGS. 3 and 4, the first recesses 14*b* are grooves extending along the depth direction Y between adjacent ones of the four metal terminals 12 arranged in the width direction X. That is, three first recesses 14*b* are provided in this embodiment. The first recesses 14*b* have the same width as the first projections 21 in the width direction X, and the first recesses 14*b* and the first projections 21 are formed such that widthwise centers thereof match. Note that the respective first recesses 14*b* extend to both ends of the upper end surface 14*a* of the core 14 (surface held in close contact with the upper end covering portion 17) in the depth direction Y. Further, a depth D1 (dimension in the height direction Z) of the first recesses 14*b* is equal to the projecting amount P1 of the first projections 21 in the height direction Z (see FIG. 3).

As shown in FIGS. 2 and 4, the second recess 14*c* is formed into a groove extending along the width direction X between the metal terminals 12 arranged in the depth direction Y. The second recess 14*c* has the same width as the second projection 22 in the depth direction Y, and the second recess 14*c* and the second projection 22 are formed at positions overlapping each other in the height direction Z. Note that the second recess 14*c* extends to both ends of the upper end surface 14*a* of the core 14 (surface held in close contact with the upper end covering 17) in the width direction X. Further, a depth D2 (dimension in the height direction Z) of the second recess 14*c* is equal to the projecting amount P2 of the second projection 22 in the height direction Z (see FIG. 2). Further, the depth D2 of the second recess 14*c* is smaller than the depth D1 of the first recesses 14*b*. The second recess 14*c* is at a center position between two of the metal terminals 12 arranged in the depth direction Y.

Further, as described above, the resin molded portion 15 including the upper end covering 17 is formed by insert molding with the core 14 as an insert article. Thus, a back surface (close-contact surface 17*b*) of the upper end covering 17 is formed with first back surface projections 23 and a second back surface projection 24 respectively conforming to the shapes of the first and second recesses 14*b*, 14*c* of the upper end surface 14*a* of the core 14. Since the shapes of the first and second back surface projections 23, 24 respectively conform to those of the first and second recesses 14*b*, 14*c*, the first back surface projections 23 and the first projections 21 have the same projecting amount in the height direction Z and also the same width in the width direction X (see FIG. 3). Further, the second back surface projection 24 and the second projection 22 have the same projecting amount in the height direction Z and also the same width in the width direction X (see FIG. 2).

The tip part 12*a* of each metal terminal 12 held in the base 11*a* of the housing 11 projects outwardly of the base 11*a* from the surface 17*a* of the upper end covering 17. The first and second recesses 14*b*, 14*c* are formed between the metal terminals 12 on the contact surface (upper end surface 14*a*) of the core 14 with the upper end covering 17. Thus, it is possible to ensure creepage distances between the metal terminals 12 on a boundary surface between the core 14 and the upper end covering 17 inside the base 11*a*.

Further, the back surface (close-contact surface 17*b* with the core 14) of the upper end covering 17 insert-molded with the core 14 as an insert article is formed with the first and second back surface projections 23, 24 respectively fit into the first and second recesses 14*b*, 14*c* of the upper end surface 14*a* of the core 14. This enables the creepage distances between the metal terminals 12 to be ensured by the recesses 14*b*, 14*c* of the core 14 (and the back surface projections 23, 24 of the upper end covering 17) while suppressing the enlargement of the base 11*a*, eventually of the connector 10, by thinning the upper end covering 17.

Further, since the first and second projections 21, 22 are formed between the metal terminals 12 on the surface 17*a* of the upper end covering 17, it is possible to ensure the creepage distances between the metal terminals 12. Further, since the projections shaped to provide the creepage distances are formed on both the surface 17*a* and the back surface (close-contact surface 17*b*) of the upper end covering 17, the upper end covering 17 can be thinned more.

The resin molded portion 15 includes the tubular fitting 13 into which the mating connector is to be fit, and the tip part 12*a* of each metal terminal 12 projecting from the surface 17*a* of the upper end covering 17 is located inside the fitting 13. The first and second projections 21, 22 formed on the surface 17*a* of the upper end covering 17 extend to the inner side surface 13*a* of the fitting 13. Thus, the creepage distances between the metal terminals 12 are ensured.

The projecting amount P1 of the first projections 21 formed on the surface 17*a* of the upper end covering 17 and the depth D1 of the first recesses 14*b* formed in the upper end surface 14*a* of the core 14 (projecting amount of the first back surface projections 23 of the upper end covering 17) are set to be equal to each other. Similarly, the projecting amount P2 of the second projection 22 formed on the surface 17*a* of the upper end covering 17 and the depth D2 of the second recess 14*c* formed in the upper end surface 14*a* of the core 14 (projecting amount of the second back surface projection 23 of the upper end covering 17) are set to be equal to each other. This can make the creepage distances between the metal terminals 12 equal on the side of the surface 17*a* and on the side of the back surface (close-contact surface 17*b*) of the upper end covering 17, with the result that electrical insulation property between the metal terminals 12 can be ensured.

Note that the above embodiment may be modified as follows.

Although the creepage distances between the metal terminals 12 are ensured by forming the projections 21, 22 on the surface 17*a* of the upper end covering portion 17 in the above embodiment, the creepage distances between the metal terminals 12 may be ensured by forming recesses instead of the projections 21, 22.

Although the creepage distances between the metal terminals 12 are ensured by forming the recesses 14*b*, 14*c* in the upper end surface 14*a* of the core 14 (i.e. by forming the back surface projections 23, 24 on the close-contact surface 17*b* of the upper end covering 17) in the above embodiment, the creepage distances between the metal terminals 12 may be ensured by forming projections instead of the recesses 14*b*, 14*c* on the upper end surface 14*a*.

The configuration of the housing 11 such as the shapes of the core 14 and the resin molded portion 15 is not limited to that of the above embodiment. For example, the fitting portion 13 may be omitted from the resin molded portion 15 of the above embodiment. Further, the core 14 may be, for example, divided into two blocks arranged in the depth direction Y, and four metal terminals 12 arranged in the width direction X may be embedded and held in each divided block.

Although the projecting amount P1 of the first projections 21 of the upper end covering portion 17 and the depth D1 of the first recesses 14*b* of the core 14 are equal to each other in the above embodiment, there is no particular limitation to this and the projecting amount P1 of the first projections 21 and the depth D1 of the first recesses 14*b* may be made different. Similarly, the projecting amount P2 of the second projection 22 of the upper end covering portion 17 and the depth D2 of the second recess 14*c* of the core portion 14 may be made different.

Although the width (dimension in the width direction X) of the first projections 21 of the upper end covering portion 17 and the width of the first recesses 14*b* of the core 14 are equal to each other in the above embodiment, there is no particular limitation to this and the width of the first projections 21 and the width of the first recesses 14*b* may be different. Similarly, the width (dimension in the depth direction Y) of the second projection 22 of the upper end covering 17 and the width of the second recess 14*c* of the core 14 may be different.

Although the first recesses 14*b* and the first projections 21 are formed such that the widthwise centers thereof match in the above embodiment, there is no limitation to this and the positions of the first recesses 14*b* and the first projections 21 may be shifted from each other in the width direction X.

Although the second recess 14*c* and the second projection 22 are formed at the positions overlapping each other in the height direction Z in the above embodiment, there is no limitation to this and the second recess 14*c* and the second projection 22 may be formed at positions not overlapping each other in the height direction Z. Further, the second recess 14*c* and the second projection 22 may be formed such that center positions thereof in the depth direction Y match.

The configuration of the metal terminals 12 such as the number and the arrangement is not limited to that in the above embodiment and may be changed as appropriate. Further, the numbers, arrangements and the like of the first and second projections 21, 22 and the first and second recesses 14*b*, 14*c* (first and second back surface projections 23, 24) may be changed according to the configuration of the metal terminals 12.

The embodiment and the respective modifications described above may be combined as appropriate.

LIST OF REFERENCE SIGNS

10 . . . connector
11 . . . housing
11*a* . . . base
12 . . . metal terminal
14 . . . core
14*a* . . . upper end surface (contact surface)
14*b* . . . first recess
14*c* . . . second recess
15 . . . resin molded portion
17 . . . upper end covering (covering)
17*a* . . . surface
23 . . . first back surface projection
24 . . . second back surface projection

What is claimed is:

1. A connector, comprising:

a primary molded body that includes:

metal terminals arranged in at least two rows with a plurality of the metal terminals in each of the rows, each of the metal terminals having a tip; and a core made of resin and having each of the metal terminals partially embedded therein, the core having a front surface and the tips of the metal terminals projecting from the front surface, a first groove extending across the front surface of the core at a position between the rows of metal terminals and second grooves extending across the front surface of the core, each of the second grooves intersecting the first groove and being between the metal terminals in each of the rows, the first and second grooves having different respective depths from the front surface of the core; and a resin molded portion formed by insert molding with the primary molded body as an insert, the resin molded portion including a covering with a back surface that covers the front surface of the core, the back surface including a first projection and second projections that completely fill the respective first and second grooves of the core;

wherein the different depths of the first and second grooves impedes liquid creepage between the metal terminals.

2. The connector of claim 1, wherein the covering of the resin molded portion further includes a front surface, the front surface of the covering including a first projection extending across the covering at a position between the rows of the metal terminals, the front surface of the covering further including a plurality of second projections extending across the front surface of the covering, each of the second projections intersecting the first projection and being between the metal terminals in each of the rows.

3. The connector of claim 2, wherein the first projection projects a first distance from the front surface of the covering and each of the second projections projects a second distance from the front surface of the covering, the first and second distances being different, thereby further impeding liquid creepage between the metal terminals.

4. The connector of claim 3, wherein the resin molded portion includes a tubular fitting projecting forward from the covering and surrounding the tips of the metal terminals.

5. The connector of claim 4, wherein the core has a width measured transverse to the metal terminals, the width of the core being less than an interior width of the tubular fitting.

6. The connector of claim 1, wherein the resin molded portion includes a tubular fitting projecting forward from the covering and surrounding the tips of the metal terminals.

7. The connector of claim 6, wherein the core has a width measured transverse to the metal terminals, the width of the core being less than an interior width of the tubular fitting.

* * * * *